United States Patent [19]

Tilley et al.

[11] Patent Number: 4,776,584

[45] Date of Patent: Oct. 11, 1988

[54] KARATE BOARD HOLDERS

[76] Inventors: Danny M. Tilley, 1503 St. Lawrence Ave.; Douglas M. Goldsmith, Paddock Rd., both of, Beloit, Wis. 53511

[21] Appl. No.: 83,175

[22] Filed: Aug. 10, 1987

[51] Int. Cl.[4] ..... A63B 69/00; B25B 29/00

[52] U.S. Cl. ..... 272/76; 294/131; 294/148

[58] Field of Search ..... 294/131, 138, 148, 166; 220/94 R; 272/76–78, 93

[56] References Cited

U.S. PATENT DOCUMENTS

| | | | |
|---|---|---|---|
| 1,625,152 | 4/1927 | Pine | 294/131 |
| 3,073,493 | 1/1963 | Pfaffenberger | 220/94 R |
| 4,171,803 | 10/1979 | Smith | 272/76 |
| 4,295,646 | 10/1981 | Squire | 272/76 |
| 4,572,504 | 2/1986 | DiBartolo | 272/76 |
| 4,583,730 | 4/1986 | Gecht et al. | 272/76 |

*Primary Examiner*—Richard J. Apley
*Assistant Examiner*—S. R. Crow
*Attorney, Agent, or Firm*—Leydig, Voit & Mayer

[57] ABSTRACT

The upper and lower end portions of a karate practice board are adapted to be clamped by upper and lower hand-held holders. Each holder includes an elastic tube for clamping the adjacent end portion of the board and further includes a U-shaped guard. When the board breaks, the guards of the holders reduce the danger of injury to the hand of the person or persons holding the holders.

8 Claims, 2 Drawing Sheets

KARATE BOARD HOLDERS

BACKGROUND OF THE INVENTION

This invention relates to a holder for a striking board and, more particularly, to a holder for a karate kick board.

In karate training, it is conventional for one or more persons to hold one or more kick boards while a student attempts to break the board or boards with a kick. As the boards are kicked, there is danger of injury to the hands of the persons holding the boards. Such danger is created when the boards break or if the student misses the boards with a miskick.

Holders for karate boards are disclosed in Smith U.S. Pat. No. 4,171,803; Squire U.S. Pat. No. 4,295,646; Dibartolo U.S. Pat. No. 4,572,504; Gecht et al U.S. Pat. No. 4,583,730 and Dignard et al U.S. Pat. No. 4,662,630. The holders disclosed in the Smith and Gecht et al patents are hand-held holders but are adapted for use with simulated striking boards rather than actual karate boards. Moreover, these holders are of relatively complex construction and require rather cumbersome-to-operate clamps for holding the boards.

SUMMARY OF THE INVENTION

The general aim of the present invention is to provide new and improved hand-held karate board holders which are of comparatively simple construction and which are adapted to hold regular karate boards in such a manner as to reduce the danger of injury to the hands as the boards are kicked and as the boards break.

Another object of the invention is to provide hand-held karate board holders which are equipped with unique guards for protecting the hands during kicking of the boards.

The invention also resides in the provision of comparatively simple and easily usable adjustable means for clamping any selected number of boards in the holders.

These and other objects and advantages of the invention will become more apparent from the following detailed description when taken in conjunction with the accompanying drawings.

DETAILED DESCRIPTION OF THE PREFERRED EMBODIMENT

Figure 1:
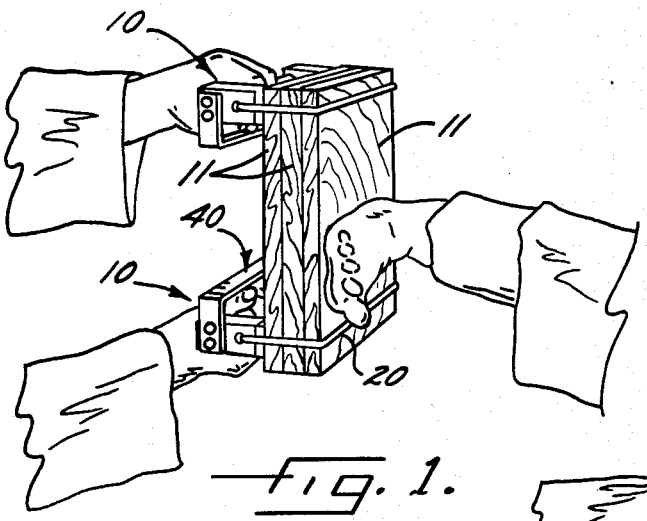
FIG. 1 is a perspective view of a pair of new and improved karate board holders incorporating the unique features of the present invention and shows the holder with boards being kicked by a karate student.

For purposes of illustration, the invention is shown in the drawings in connection with hand-held holders 10 for one or more striking boards 11 used as a kick board in karate exercises. Each of the present boards 11 is a standard rectangular board having dimensions of about 10" by 12" and a thickness of about ¾". Two identical holders 20 are used and, in the present instance, are located adjacent the upper and lower end portions of the kick boards. It is conventional for one assistant to grab the holders at one end portion thereof and for a second assistant to grab the other end portions of the holders but, for purposes of simplicity, the drawings show the holders being held by only one person.

The present invention contemplates the provision of relatively simple and inexpensive karate board holders 10 which are uniquely constructed to reduce the danger of injury to the assistants' hands during kicking and breaking of the boards 11. Moreover, the holders may be easily adjusted to support either one or several boards and enable boards to be placed in and removed from the holders in a quick and simple manner.

Figure 3:
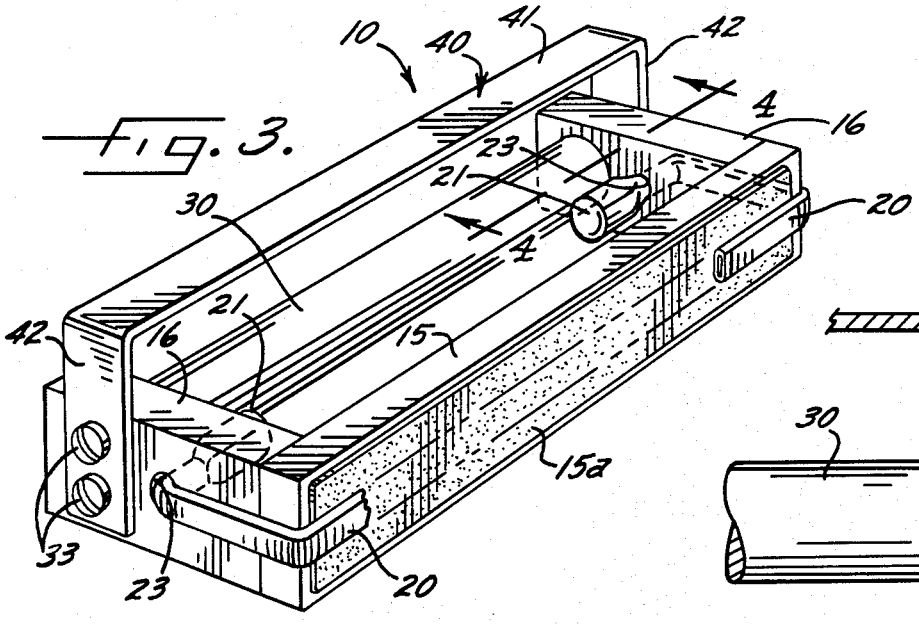
FIG. 3 is a perspective view of one of the holders.

As pointed out above, the upper and lower holders 10 are identical and thus only the lower holder will be described in detail. As shown in FIG. 3, the lower holder includes a flat plate-like member 15 having a width substantially equal to that of the boards 11 and adapted to lie flat against the rear side of the rearward-most board adjacent the lower end portion thereof. The plate is made of hard and rigid plastic and has a height of about 1½". A strip 15*a* (FIG. 3) of anti-slip material is cemented to the forward side of the plate.

Connected to and extending rearwardly from the ends of the plate 15 are two bars 16. The bars also are made of hard plastic and are fastened rigidly to the rear side of the plate 15 by screws (not visible) and also by a strong adhesive.

Novel means for holding the boards 11 are connected to the bars 16 and extend along the front side of the plate 15. Herein, these means comprise an elongated piece 20 of elastic material which, in the present instance, is a 14" length of rubber surgical tubing. The tube 20 is circular in cross-section and has an inside diameter of about ¼" and an outside diameter of about ⅝".

As shown in FIG. 3, the major length of the tube 20 extends along the outer side of the plate 15 while the two end portions 21 of the tube are threaded through holes 23 formed horizontally through the bars 16. The holes 23 are circular in cross-section and have a diameter of about ¼". Thus, it is necessary to compress the tube 20 significantly to thread the end portions 21 of the tube through the holes. The tube portions which are actually located in the holes are pinched radially and thus are gripped tightly within the holes.

Figures 5, 6:
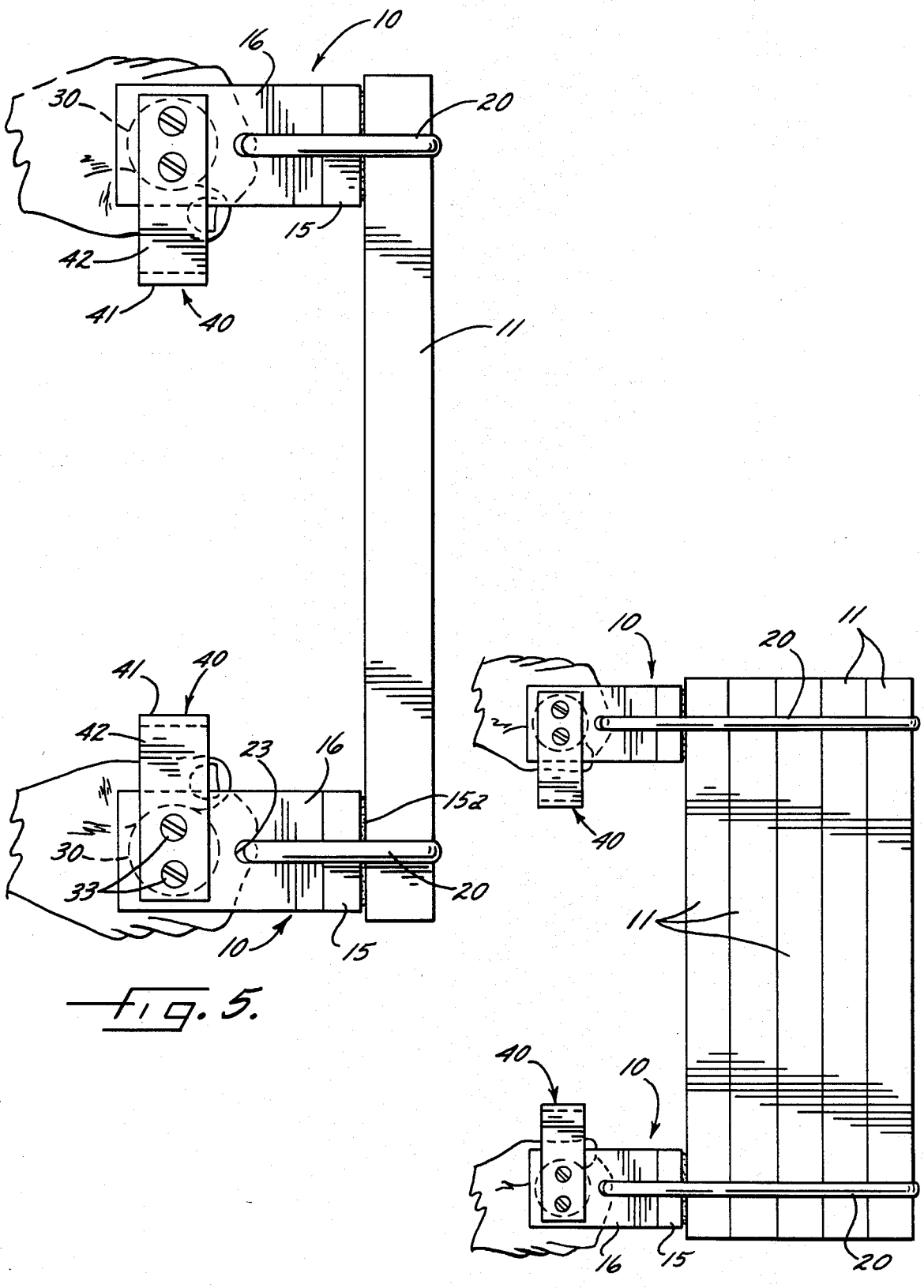
FIG. 5 is an enlarged side elevational view of the holders and shows a single board being held by the holders.
FIG. 6 is a view similar to FIG. 5 but on a reduced scale and showing a relatively large number of boards being held by the holders.

With the foregoing arrangement, the lower end portions of the boards 11 may be slipped between the plate 15 and the tube 20 by stretching the tube forwardly away from the front side of the plate. When the tubing is released and contracts, it clamps the lower ends of the boards tightly against the plate, the rear face of the rear board engaging the anti-slip material 15*a*. If tighter clamping of the boards is desired, the end portions 21 of the tube may be pulled toward one another to contract the major length of the tube more tightly against the plate 15. Also, the major length of the tube may be pulled forwardly with a relatively large force so as to cause the end portions of the tube to slip outwardly relative to the holes 23. This increases the relaxed dimension of the major length of the tube and enables the tube to clamp the lower end portions of a greater number of face-to-face boards 11 as shown in FIG. 6. By shortening the tube, the tube may be adapted to grip only one board as shown in FIG. 5. Thus, it is a relatively simple matter to adjust the tube so as to cause the tube to clamp only a single board or to clamp a selected plurality of boards.

Figure 4:
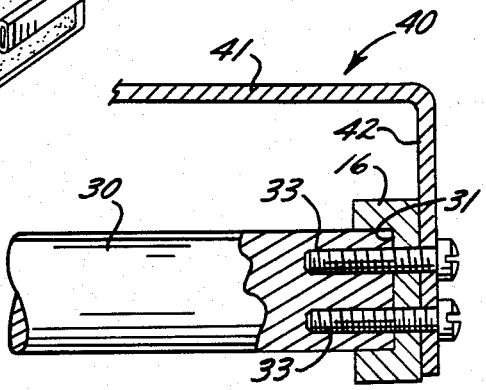
FIG. 4 is an enlarged fragmentary cross-section taken substantially along the line 4—4 of FIG. 3.

To enable the holder 10 to be held by the hands of the assistants, an elongated and generally cylindrical handle 30 (FIG. 3) extends parallel to the plate 15 in rearwardly spaced relation therefrom so as to define a hand opening between the plate and the handle. The end portions of the handle are seated in cylindrical pockets 31 (FIG. 4) in the inboard sides of the rear end portions of the bars 16 and are secured to the bars by a strong adhesive. In addition, two screws 33 extend through each bar 16 and into the adjacent end portion of the handle 30 so as to help secure the handle to the bars and to prevent the handle from rotating about its own axis. During use of the holders 10, each assistant grips one end portion of the handle 30 of each holder and thereby properly positions the boards 11 for kicking by the student while resisting rearward movement of the boards.

Pursuant to the invention, each holder 10 is uniquely equipped with a guard 40 which protects the hands of the assistants and reduces the likelihood of injury to the hands when the boards 11 are broken or if the student should miss the boards. Herein, the guard of each holder is formed by a U-shaped piece of heavy steel having an elongated guard section 41 and having leg sections 42 formed integrally with and extending perpendicular to the guard section. The leg sections are secured rigidly to the outboard sides of the bars 16 by the screws 33, the legs extending perpendicular to the bars.

Figure 2:
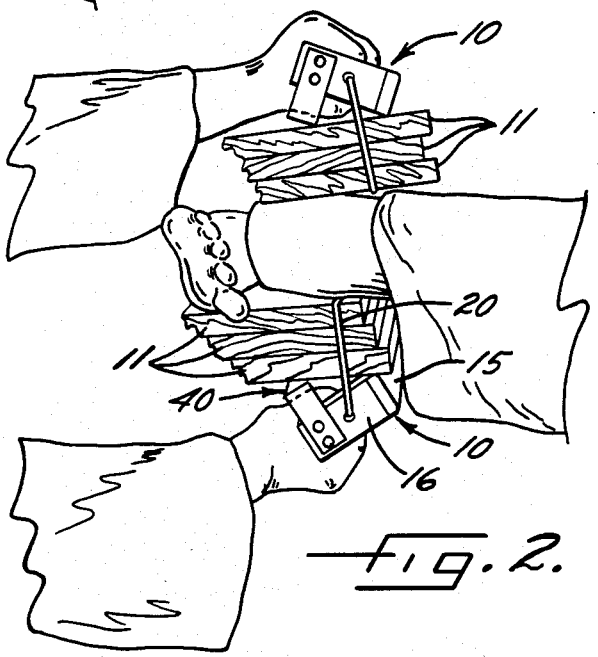
FIG. 2 is a view similar to FIG. 1 but shows the holders as the boards are broken by the student.

When the holders 10 are used, the lower holder is positioned such that the leg sections 42 of its guard 40 extend upwardly so as to cause the guard section 41 of the holder to be located behind the boards 11 and to overlie the hands of the assistants. The upper holder 10 is inverted relative to the lower holder and thus the leg sections 42 of the guard 40 of the upper holder extend downwardly (see FIG. 5). This locates the guard section 41 of the upper holder behind the boards and in underlying relation with the hands of the assistants. When the boards are broken between the plates 15 of the two holders, the upper and lower sections of the board swing rearwardly to the position shown in FIG. 2. The guards 40 prevent the broken board portions from striking the hands and thus reduce the danger of injury to the hands. In addition, there is no need to place the hands in front of the boards and thus the hands are protected from the kicking foot.

From the foregoing, it will be apparent that the present invention brings to the art a new and improved karate board holder 10 which guards the hands of the assistants and which may be easily adjusted to hold a different number of boards 11. The holder is of relatively simple construction and enables comparatively quick and easy insertion and removal of the boards. By virtue of the rubber tubing 20, the student is not likely to be injured if the student's foot strikes the tubing during an off target kick.

We claim:

1. A hand-held holder for a generally planar striking board having opposite end portions and having front and rear sides, said holder comprising a member adapted to lie against the rear side of the board adjacent one end portion of the board, means for releasably clamping said one end portion of said board to said member, an elongated handle attached to said member with said handle being spaced rearwardly from said board, there being an opening between said handle and said member to enable a hand to grip said handle, and a guard attached to and extending generally parallel to said handle for protecting the hand against injury when the board is kicked, said guard being spaced from said handle in a direction such that the distance between said guard and the opposite end portion of said board is less than the distance between said handle and the opposite end portion of said board.

2. A holder as defined in claim 1 in which said clamping means comprise an elongated elastic element extending alongside the front side of said member.

3. A holder as defined in claim 2 further including bars connected to and extending rearwardly between the end poritons of said member and the end portions of said handle, said elastic member having end poritons attached adjustably to said bars.

4. A holder as defined in claim 1 in which said guard includes an elongated guard section extending substantially parallel to said handle, said guard further including leg sections extending generally perpendicular to said guard section and extending away from said guard section and toward said handle and said one end portion of said board.

5. A hand-held holder for a generally planar striking board having opposite end portions and having front and rear sides, said holder comprising a flat plate adapted to lie against the rear side of the board adjacent one end portion of the board, bars extending rearwardly from opposite end portions of the plate, a handle spanning the rear end portions of said bars and extending generally parallel to said plate in rearwardly spaced relation therefrom thereby to define a hand opening between the handle and the plate, an elongated elastic element connected to said bars and extending along the front side of said plate, said elastic element being operable to clamp said one end portion of said striking board against the front side of said plate, and a guard for protecting the hand against injury from the striking board as the latter is kicked, said guard comprising a generally U-shaped member having leg sections attached to said bars and extending away from said bars and toward the opposite end portion of said board, said guard further having an elongated guard section attached to said leg sections and extending generally parallel to said handle in spaced relation therefrom.

6. A holder as defined in claim 5 further including a hole formed in each of said bars, said elastic element comprising an elongated piece of resiliently yieldable tubing having end portions threaded through and pinched within said holes

7. A hand-held holder for a generally planar striking board having upper and lower end portions and having front and rear sides, said holder comprising a flat and generally horizontal plate adapted to lie against the rear side of the board adjacent one end portion of the board, bars extending rearwardly from opposite end portions of said plate, each of said bars having a horizontally extending circular hole formed therethrough, an elongated piece of elastic of circular cross-section extending along the front side of said plate and operable to clamp said one end portion of said board against the front side of said plate, said elastic having end portions threaded through and pinched within said holes, a generally horizontal handle spanning the rear end portions of said bars and extending generally parallel to said plate in rearwardly spaced relation therefrom so as to define a hand opening between the handle and the plate, and a guard for protecting the hand against in]ury from the striking board as the board is kicked, said guard being generally U-shaped and having vertical leg sections attached to the rear end portions of said bars and extending from the bars and toward the opposite end portion of said board, said guard further including an elongated and generally horizontal guard section attached to said leg sections and extending generally parallel to said handle in vertically spaced relation therefrom.

8. A holder as defined in claim 7 in which said piece of elastic is tubular.

* * * * *